US008485147B2

(12) United States Patent
Liu et al.

(10) Patent No.: US 8,485,147 B2
(45) Date of Patent: Jul. 16, 2013

(54) IMPINGEMENT COOLING OF CYLINDERS IN OPPOSED-PISTON ENGINES

(75) Inventors: Feng Song Liu, San Diego, CA (US); Jiongyang Wu, San Diego, CA (US); Patrick R. Lee, San Diego, CA (US)

(73) Assignee: Achates Power, Inc., San Diego, CA (US)

( * ) Notice: Subject to any disclaimer, the term of this patent is extended or adjusted under 35 U.S.C. 154(b) by 111 days.

(21) Appl. No.: 13/136,402

(22) Filed: Jul. 29, 2011

(65) Prior Publication Data

US 2013/0025548 A1 Jan. 31, 2013

(51) Int. Cl.
*F02B 25/08* (2006.01)

(52) U.S. Cl.
USPC ..... 123/51 B

(58) Field of Classification Search
USPC ..... 123/51 R, 51 B, 51 BA, 51 BD, 123/52.2
See application file for complete search history.

(56) References Cited

U.S. PATENT DOCUMENTS

| | | | | | |
|---|---|---|---|---|---|
| 1,231,903 | A | | 7/1917 | Junkers | |
| 1,818,558 | A | | 11/1929 | Junkers | |
| 2,244,323 | A | * | 6/1941 | Antonsen et al. | 123/41.78 |
| 2,412,952 | A | * | 12/1946 | Daub | 123/51 BB |
| 2,473,936 | A | * | 6/1949 | Burrough | 123/45 R |
| 2,998,808 | A | * | 9/1961 | Jackson | 123/41.72 |
| 3,866,581 | A | * | 2/1975 | Herbert | 123/51 B |
| 5,058,536 | A | * | 10/1991 | Johnston | 123/51 BA |
| 6,182,619 | B1 | | 2/2001 | Spitzer et al. | 123/51 B |
| 8,276,552 | B2 | * | 10/2012 | Lemke et al. | 123/41.35 |
| 2009/0293820 | A1 | | 12/2009 | Lemke et al. | 123/41.35 |
| 2010/0212613 | A1 | | 8/2010 | Lemke et al. | 123/52.2 |
| 2010/0212637 | A1 | | 8/2010 | Lemke et al. | 123/51 R |
| 2010/0212638 | A1 | | 8/2010 | Rado et al. | 123/51 R |

* cited by examiner

*Primary Examiner* — M. McMahon
(74) *Attorney, Agent, or Firm* — Terrance A. Meador; Incaplaw

(57) ABSTRACT

A cylinder cooling construction includes a cylinder liner with a sidewall, exhaust and intake ports opening through the sidewall, a bore, and a plurality of feed channels that are formed with and extend along the sidewall from a central band of the cylinder toward the exhaust and intake ports. A sleeve covering the sidewall includes a plurality of impingement jet ports that are arranged in at least one sequence extending around the central band and that are in liquid communication with the plurality of feed channels. An annular member disposed between the liner and the sleeve reinforces the central band. The sleeve further includes an inside surface with spaced-apart annular recesses that with the sidewall define liquid coolant reservoirs in the vicinity of the ports that are in liquid communication with the feed channels. Channels through bridges of exhaust port have first ends in liquid communication with the coolant reservoir in the vicinity of the exhaust port and second ends that open through a portion of an exhaust end of the cylinder.

23 Claims, 7 Drawing Sheets

IMPINGEMENT COOLING OF CYLINDERS IN OPPOSED-PISTON ENGINES

RELATED APPLICATIONS

This application contains subject matter related to the subject matter of the following pending US patent applications:

U.S. Ser. No. 12/456,735, filed Jun. 22, 2009, for "Two-Cycle, Opposed-Piston Internal Combustion Engine", published as US 2009/0293820 A1 on Dec. 3, 2009;

U.S. Ser. No. 12/658,696, filed Feb. 12, 2010, for "Multi-Cylinder Opposed Piston Engines", published as US 2010/0212613 on Aug. 26, 2010;

U.S. Ser. No. 12/658,697, filed Feb. 12, 2010, for "Opposed Piston Engines with Controlled Provision of Lubricant for Lubrication and Cooling", published as US 2010/0212638 on Aug. 26, 2010; and, U.S. Ser. No. 12/658,695, filed Feb. 12, 2010, for "Cylinder and Piston Assemblies for Opposed Piston Engines", published as US 2010/0212637 on Aug. 26, 2010.

BACKGROUND

The field covers a ported cylinder for an opposed-piston engine. More particularly, the field relates to impingement cooling of a ported cylinder in a two-stroke opposed-piston engine.

In a two-stroke, opposed-piston engine, two pistons are disposed in opposition in the bore of an elongated cylinder. Exhaust and intake ports are provided through the cylinder sidewall near respective ends of the cylinder. When the engine operates the pistons slide toward and away from each other in the cylinder bore. As the pistons slide together, air is compressed between their end faces and combustion occurs when fuel is injected into the compressed air. The piston end faces contain combustion in a relatively narrow cylindrical space in the cylinder bore, whose side is defined by a circumferential portion of the cylinder sidewall that is substantially centered between the exhaust and intake ports. This circumferential portion is referred to as the central band of the cylinder. As the piston's slide away from the central band in response to combustion, they open the exhaust and intake ports to enable uniflow scavenging wherein pressurized air flowing into the cylinder bore via the intake port forces combustion products out of the bore through the exhaust port.

A cooling system construction for such a two-stroke opposed-piston engine is substantially different from that of a four-stroke engine. In an opposed-piston engine, combustion concentrates the thermal load at the central band, and the unidirectional flow of air during scavenging results in a non-symmetrical distribution of heat from the central band toward the ends of the cylinder. That is to say, while the central band is the hottest portion of the cylinder, the exhaust end of the cylinder is hotter than the intake end. This asymmetric thermal loading causes longitudinal and circumferential distortions of the cylinder. Distortions of the cylinder lead to increased friction between the pistons and cylinder bore, scuffing of the bore, and reduced durability of the engine.

The high concentration of heat in the central band poses another threat to engine lifetime. As combustion occurs, the opposed pistons (not shown) pass through top dead center (TDC) locations. After the pistons TDC, they reverse direction and begin to move away from each other in response to the pressure of combustion. As reversal begins, combustion causes a sudden rise in pressure in the central band that seats the rings of each piston firmly against a bore surface zone ("the top ring reversal zone") that overlaps the central band.

The spike in friction between the rings and the bore can cause increased wear of the bore surface. Thus, it is important to engine durability that the lubricating oil film in the top ring reversal zone be preserved in the face of the thermal load borne by the central band.

A simple cooling construction for a two-stroke, opposed-piston engine includes a jacket within which liquid coolant flows along the cylinder sidewall in an axial direction from an inlet near the intake port to an outlet near the exhaust port. For example, in the cylinder liner cooling construction described in U.S. Pat. No. 6,182,619, liquid coolant flows over the external surfaces of a cylinder housing, in a direction from the intake end to the exhaust end. However, this construction yields uneven cooling both longitudinally and circumferentially about the cylinder housing.

Improved thermal response has been achieved in a ported cylinder for an opposed-piston engine by introducing the coolant near the central band and providing means to transport the coolant from the central band toward either end of the cylinder. See FIG. 3E of US 20100212613 wherein coolant flows into a circumferential groove on the exterior surface of a portion of the cylinder sidewall in the central band, and through longitudinal grooves on either side of, and in liquid communication with, the central groove toward the intake and exhaust ends of the cylinder structure. FIGS. 11A and 11B of US 2009/0293820 show a cylinder cooling construction including three groups of grooves in the sidewall of a cylinder liner. A group of grooves runs in the direction of the central circumference of the cylinder liner. Separate groups of grooves extend longitudinally from either side of the central group of grooves, toward respective ports. A sleeve disposed over the central band provides separate input ports for each group of grooves.

In the central band of both of these constructions, there are circumferential grooves and openings for injectors that significantly weaken the cylinder structural integrity at the central band and raise cylinder reliability and durability issues. Further, the heat transfer coefficient of coolant surface flow is limited by coolant flow velocity and local geometry, so the cooling capacity in the central band is limited in its effectiveness. This can cause the temperature of the cylinder structure at the central band to exceed the design limits of the cylinder material, leading to excessive liner distortion that causes exhaust blow-by, stress concentration on the cylinder, and excessive ring and cylinder bore wear.

These problems are avoided by a cylinder cooling system for a two-stroke opposed-piston engine that combines mechanical reinforcement of the central band with impingement cooling of the central band, flow cooling of portions of the sidewall between the central band and the ports, and reservoir cooling of portions of the sidewall in the vicinity of the ports.

One objective of such a cooling system is to reduce the thermal variance in the longitudinal and circumferential dimensions of the cylinder in order to maintain its linearity and circularity. Ideally, this objective is achieved by cooling the cylinder in an asymmetric manner that is the inverse of the asymmetrical manner in which it is thermally loaded during engine operation.

It is an objective to provide such cooling while maintaining the structural integrity of the cylinder by strengthening the central band area. In one preferred instance, the cylinder's structural integrity is maintained by elimination of circumferentially-directed grooves in the central band.

Another objective is to limit the temperature of the cylinder in the ring reversal zone so as to prevent or mitigate loss of viscosity and burn-off of the lubricating oil film. This objective is achieved by direction of impingement jets of liquid against the sidewall in or in the vicinity of the central band where piston rings encounter the highest levels of heat and bore distortion.

It is an objective to provide such reinforcement and cooling of the central band while reducing and equalizing the wall temperature and distortion along the whole stroke length of the cylinder as well as around the bore circumference, so as to increase cylinder liner and piston ring reliability and durability.

SUMMARY

A cylinder cooling system supplies jets of liquid coolant that impinge upon the cylinder sidewall in or in the vicinity of the central band. Preferably, the jets travel to the sidewall in a radial direction of the cylinder. Respective portions of the liquid coolant thereby introduced against the sidewall flow in contact with the sidewall from the central band toward the exhaust and intake ports of the cylinder structure. This maximizes the cooling effect on the central band by focusing impingement cooling jets on this high heat concentration area, while also providing liquid coolant to cool the sidewall in the directions of the ports.

Delivery of liquid coolant to the central band is provided without grooves that extend circumferentially in the central band, thereby eliminating one deficiency in the integrity of the cylinder. Further, the structure of the cylinder at the central band is mechanically reinforced by an annular member that encircles the combustion chamber in the central portion. In some aspects, the annular member is internal to the cylinder sidewall; in other aspects, it is disposed on an external surface of the sidewall.

From the central band, the liquid coolant is transported in contact with the sidewall through feed channels, toward the exhaust and intake ports of the cylinder. The liquid coolant flows from the flow channels into respective reservoirs located in the vicinity of the exhaust and intake ports. The reservoirs accumulate liquid coolant in contact with the sidewall sections in the vicinity of the ports so as to maintain the circularity of the bore at the locations between the central band and the port bridges where it adjoins the ports. The liquid coolant is circulated out of the reservoirs to be cooled and reintroduced into the cooling mechanism.

In some embodiments, the cooling system includes at least one plurality of impingement jet ports around the central band. Preferably, the jet ports are arranged in one or more sequences that extend along a circumferential direction of the central band. For example, a plurality of jet ports is arranged in an annulus around the central band, in alignment with one or more injector ports. In another example, a plurality of jet ports is arranged in a first annulus and a second annulus, in which the first and second annuluses are disposed along respective sides of a circumferential rib in the central band that includes the one or more injector ports.

A cylinder cooling construction for an opposed-piston engine includes a cylinder liner with a sidewall, longitudinally-spaced exhaust and intake ports opening through the sidewall, a bore, and a plurality of feed channels that are formed with and extend along the sidewall from a central band of the cylinder toward the exhaust and intake ports. A sleeve covering the sidewall includes a plurality of impingement jet ports that are arranged in at least one sequence extending around the central band and that are in liquid communication with the plurality of feed channels. The sleeve further includes an inside surface with spaced-apart annular recesses that, with the sidewall, define liquid coolant reservoirs in the vicinity of the ports that are in liquid communication with the feed channels. Preferably, channels through bridges of exhaust port have first ends in liquid communication with the coolant reservoir in the vicinity of the exhaust port and second ends that open through a portion of an exhaust end of the cylinder. The sleeve includes an annular member reinforcing the sidewall in the central band.

In one embodiment, the cooling mechanism includes a plurality of impingement jet ports arranged in a sequence that extends around the central band, preferably in a circumferential direction of the central band. In some aspects, the plurality of jet ports is arranged in an annulus around the central band, in alignment with a circumference of the cylinder with which one or more injector ports are aligned. Each jet port opens into a feed channel extending along the cylinder sidewall between the exhaust and intake ports. First ends of the feed channels open into a first reservoir that extends in a circumferential direction around the cylinder liner, in the vicinity of the exhaust port. Second ends of the feed channels open into a second reservoir that extends in a circumferential direction around the cylinder liner, in the vicinity of the intake port. One or more loop channels extend from the first to the second reservoir. Liquid coolant jets striking a sidewall surface in the central band of the cylinder liner are redirected into feed channels that transport liquid coolant to the first and second reservoirs. Liquid coolant collected in the second reservoir is transported to the first reservoir via the loop channels. Liquid coolant is circulated out of at least the first reservoir to be cooled and then reintroduced into the cooling mechanism. In some aspects, port channels are provided through bridges in the exhaust port for the passage of liquid coolant from the first reservoir through the exhaust port. An annular band of material having a raised central aisle is seated in the cylinder bore in alignment with the circumference of the impingement jet and injector ports.

In a second embodiment, the cooling mechanism includes a plurality of jet ports arranged in sequences that extend around the central band, on either side of an annular member of the sidewall where one or more injector ports are provided. Preferably, each sequence extends in a circumferential direction of the cylinder liner. First jet ports open into first feed channels that extend along the cylinder wall between the annular member and the exhaust port. Second jet ports open into second feed channels that extend along the cylinder wall between the annular member and the intake port. The first feed channels open into a first reservoir that extends in a circumferential direction around the cylinder liner, in the vicinity of the exhaust port. The second feed channels open into a second reservoir that extends in a circumferential direction around the cylinder liner, in the vicinity of the intake port. Liquid coolant jets striking a sidewall surface in the central band of the cylinder liner are redirected into feed channels that transport liquid coolant to the first or second reservoirs. Liquid coolant is circulated out of the first and second reservoirs to be cooled and then reintroduced into the cooling mechanism. In some aspects, port channels are provided through bridges in the exhaust port for the passage of liquid coolant from the first reservoir through the exhaust port.

DETAILED DESCRIPTION OF THE PREFERRED EMBODIMENTS

Figure 1:
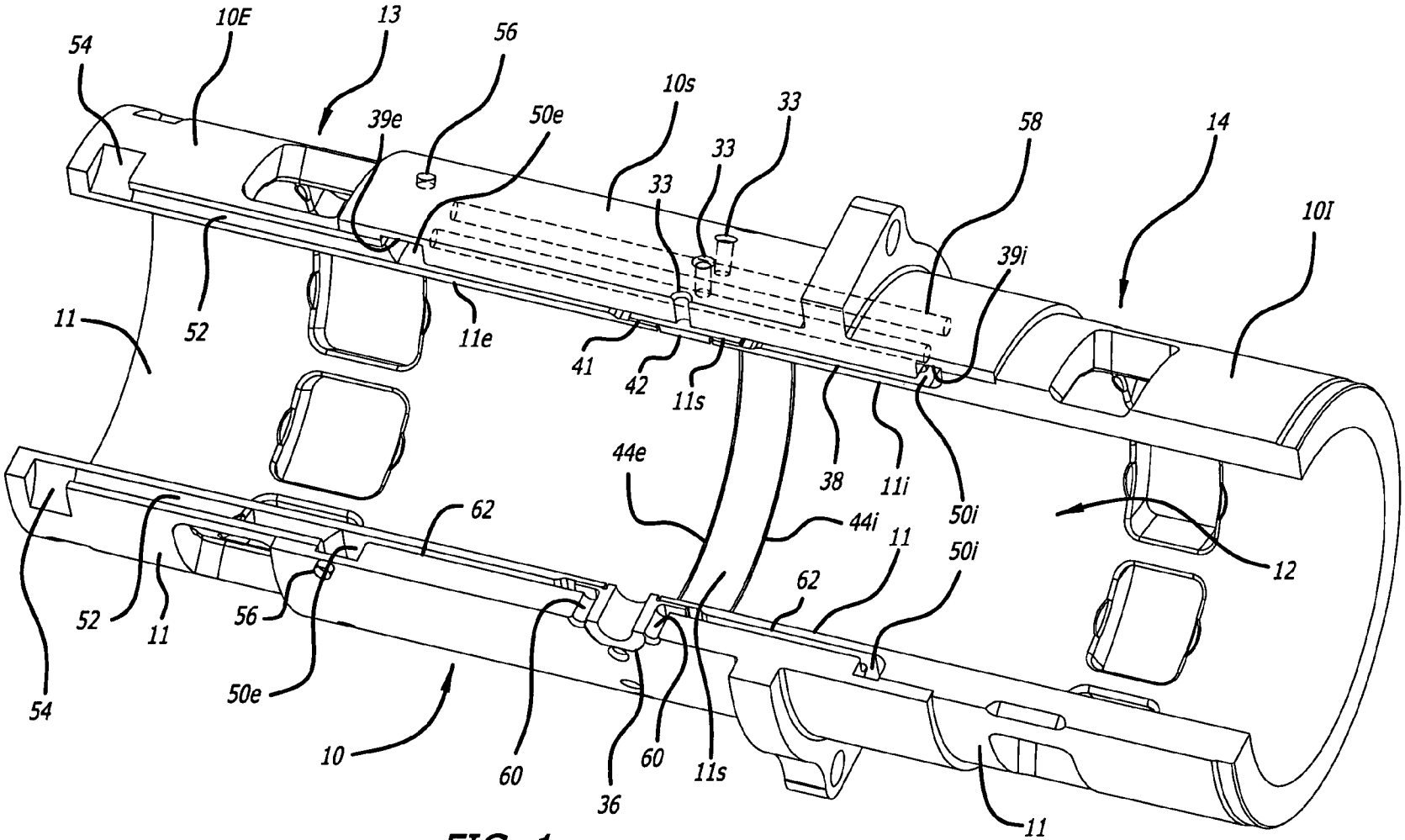
FIG. 1 is a partially cut away perspective view of a cylinder of an opposed-piton engine equipped with a first impingement cooling construction.
Figure 3:
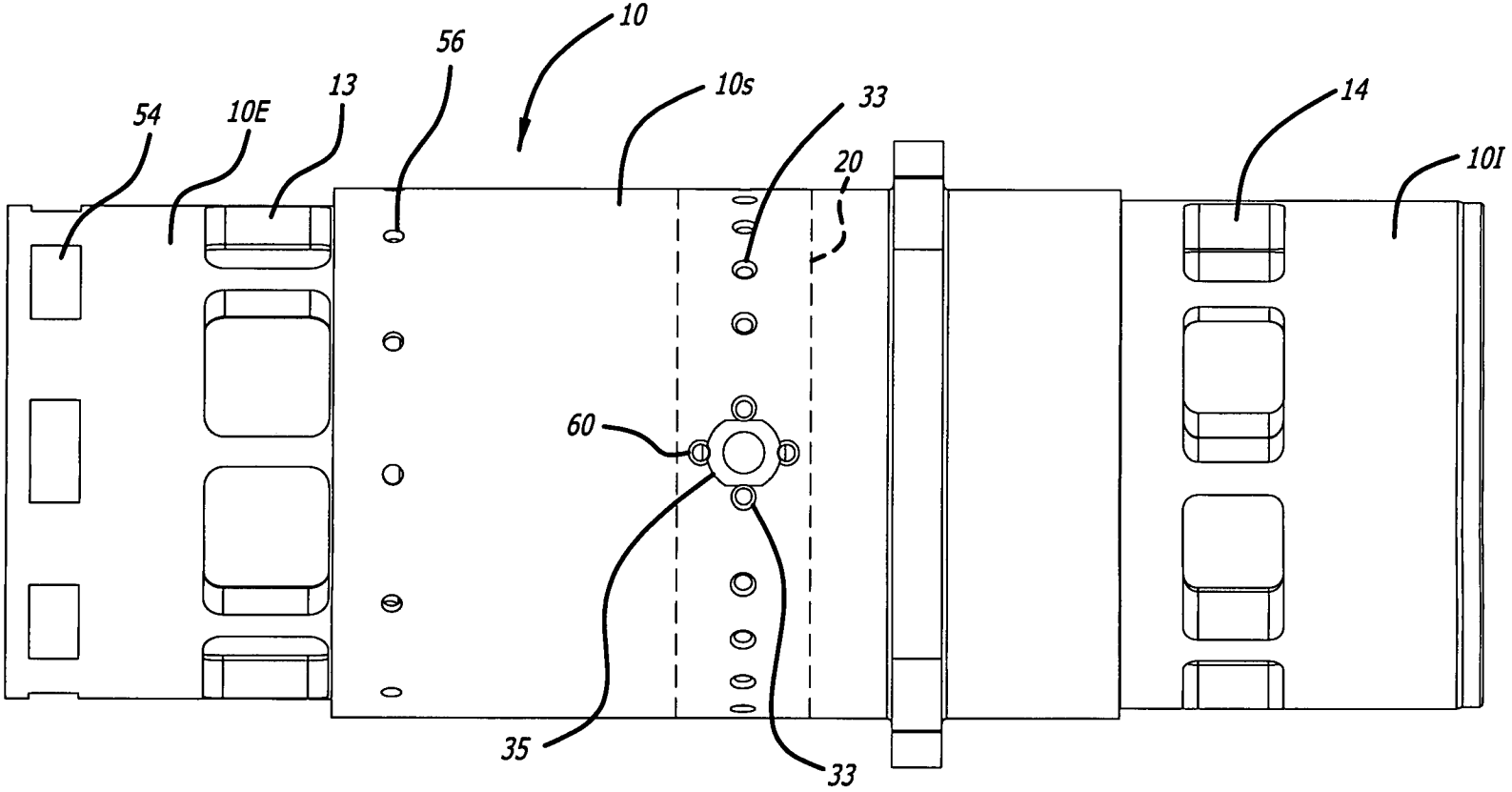
FIG. 3 is a side elevation view of the single cylinder of FIG. 1.

As seen in FIGS. 1 and 3, a cylinder assembly 10 of an opposed-piston engine has a sidewall 11, a bore 12, and longitudinally-separated exhaust and intake ports 13 and 14. Each of the ports is constituted of one or more sequences of openings through the liner that are separated by solid sections of the sidewall. These solid sections are called "bridges". The central band of the cylinder is an annular portion of the sidewall surrounding bore space in which combustion takes place; it occupies a zone of the cylinder disposed generally midway between the exhaust and intake ports. A central band 20 is represented by dashed lines in FIG. 3, but this is merely for illustration and is not intended to indicate a discrete and precisely dimensioned element of the cylinder.

Due to combustion in the space surrounded by the central band, the heat load of an opposed-piston engine is highly concentrated in that portion of the cylinder assembly. Desirably, the structural integrity of the cylinder assembly is maintained by an absence of one, or more circumferentially-directed grooves for transporting liquid coolant therein. Moreover, the structural integrity of the cylinder is enhanced by provision of a reinforcing annular member disposed in the central band and acting to reinforce the central band. Desirably, the temperature of the bore surface in the central band is limited by provision of impingement cooling of the central band with jets of liquid coolant injected through jet ports in the sidewall of a cylinder liner. The combination of impingement jets, multiple channels for delivery of coolant to the sidewall, and reservoirs in the vicinity of the ports of the cylinder ensures that those areas are adequately cooled to achieve a substantially uniform temperature profile for the entire cylinder assembly.

First Embodiment: In a first embodiment illustrated in FIGS. 1-4, as the jets injected toward the central band strike the cylinder sidewall, they are redirected into groups of coolant channels that extend in axial directions of the cylinder liner. One group of coolant channels transports liquid coolant to an exhaust coolant reservoir in the vicinity of the exhaust port and to an intake coolant reservoir in the vicinity of the intake port. Liquid coolant exits the exhaust coolant reservoir through bypass holes. Liquid coolant collected in the intake coolant reservoir is transported though a group of loop channels to the exhaust reservoir. One or more ports that open through the central band into the cylinder bore are provided for mounting fuel injector nozzles; other such ports may be provided for mounting sensors, braking valves, and/or other mechanisms that require access to the bore. Another group of jet ports in the vicinity of at least one injector port are in liquid communication with another group of coolant channels that transport liquid coolant only to one or the other of the exhaust and intake coolant reservoirs. Liquid coolant is transported from the exhaust coolant reservoir through passages that extend through exhaust port bridges to an exhaust manifold coolant jacket.

Figure 2:
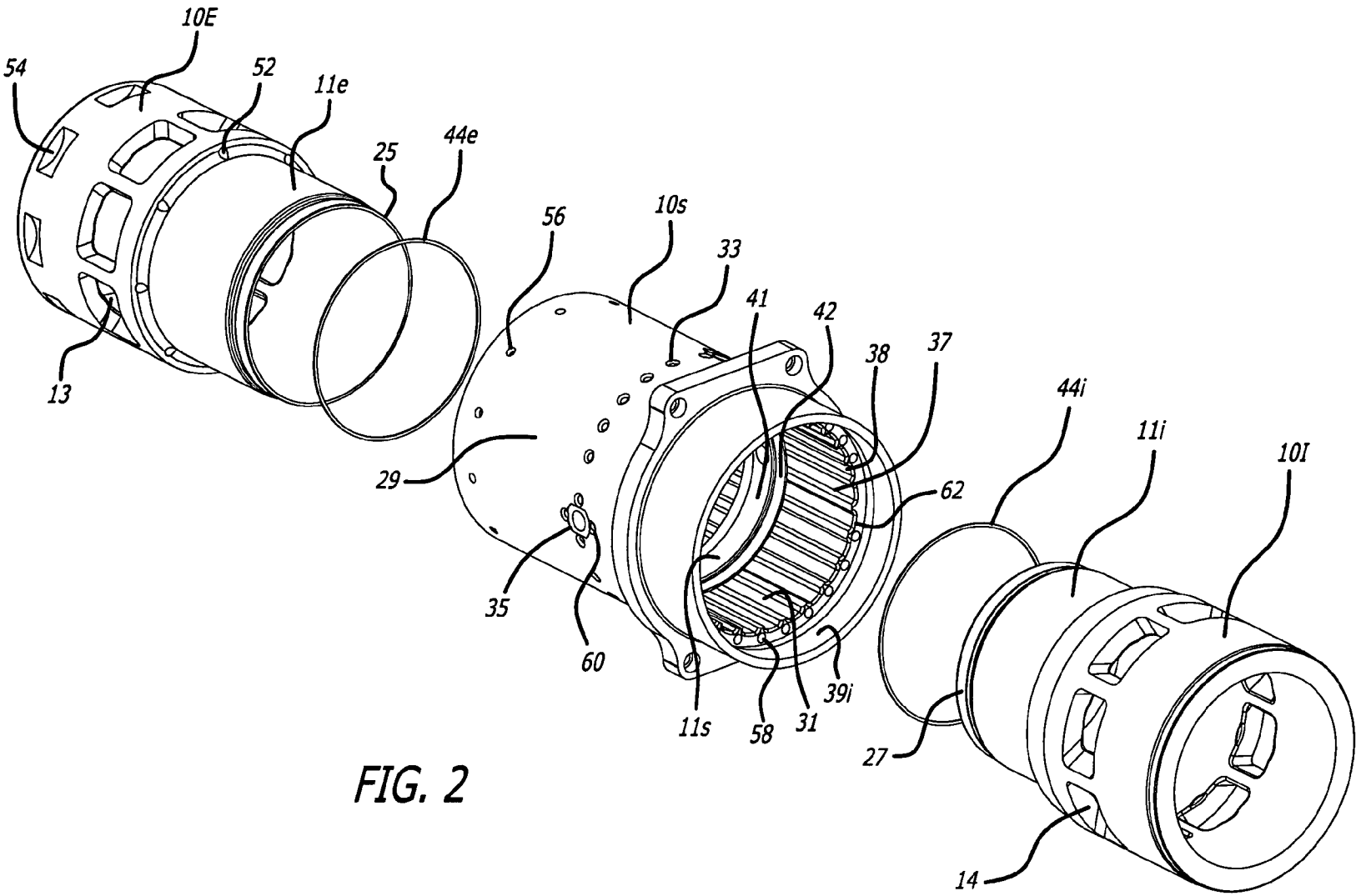
FIG. 2 is an exploded perspective view of the cylinder of FIG. 1.

Referring to FIGS. 1 and 2, the opposed-piston engine cylinder assembly 10 includes three elements: an exhaust section 10E, an intake section 10I, and a sleeve 10S. The exhaust section 10E is a cylindrical piece that is formed by casting and/or machining to include a rear portion in which the openings of the exhaust port 13 are formed. Forward of the rear portion, the outer diameter of the exhaust section 10E decreases so as to define a sidewall section 11*e*, and decreases again at the forward end 25 of the exhaust section 10E. Similarly, the intake section 10I is a cylindrical piece that is formed by casting and/or machining to include a rear portion in which the openings of the intake port 14 are formed. Forward of the rear portion, the outer diameter of the intake section 10I decreases so as to define a sidewall section 11*i*, and decreases again at the forward end 27 of the intake section 10I. The cylinder sleeve 10S is a cylindrical piece that is formed by casting and/or machining to include outer and inner surfaces 29 and 31. A plurality of impingement jet ports 33 are arranged in a sequence extending in a circumferential direction of the sleeve 10S. The jet ports 33 are formed by drilling through the sleeve 10S from the outer to the inner surfaces 29, 31. Preferably, the centerlines of the jet ports are aligned with radii of the sleeve 10S. At least one injector port 35 located on the same circumference as the jet ports 33 is formed by drilling in a radial direction of the sleeve 10S. As best seen in FIG. 1, each injector port includes a boss 36 having a flared collar for seating and retention. The inside surface 31 of the sleeve 10S has a central portion in which a sequence of longitudinal ribs 37 is formed. The spaces between the ribs 37 constitute open feed channels 38 that are described in more detail below. Outboard of the central portion, at each end of the inside surface 31, the inside diameter of the sleeve 10S increases, thereby forming spaced-apart annular recesses 39*e* and 39*i* that define respective liquid coolant reservoirs on the sidewall of the cylinder assembly 10. A reinforcing annular member is constituted of a ring 41 of material having a raised central aisle 42. The ring 41 is seated on the inside surface 31 in alignment with the circumference of the impingement jet and injector ports 33 and 35. The ring 41 is composed of the same material as the elements 10E, 10I, and 10S or a material compatible therewith. As per FIGS. 1 and 2, the ring 41 is drilled out at locations that are concentric with the injector ports 35.

As per FIGS. 1-3, the cylinder 10 is assembled by inserting the sidewall sections 11*e* and 11*i* of 10E and 10I into respective ends of the sleeve 10S so as to bring the forward portions 25 and 27 against the sides of the raised central aisle 42, with metal sealing rings 44*e* and 44*i* sealing the spaces therebetween. The sections 10E and 10I and the sleeve 10S can be joined by one or more of press fitting, interference fitting, shrink fitting, welding, and soldering, or any equivalent thereof. This construction permits the application of liquid coolant to the cylinder assembly while sealing the bore 12 and the one or more ports where fuel injector nozzles, sensors, braking valves, and/or other mechanisms that require access to the bore are to be mounted. Further, the ring 41 that encircles the combustion space of the cylinder receives the pressure of combustion when ignition occurs. It reinforces the central band of the cylinder, including the ports where fuel injector nozzles, sensors, braking valves, and/or other mechanisms are mounted.

The elements of the cylinder assembly can be made out of metallic material such as cast iron, steel, aluminum, bronze, and/or other equivalent materials. The multi-piece construction of the cylinder structure allows combinations that would align material characteristics with operational requirements. For example, the exhaust and intake sections 10E and 10I can be made of material with good tribological properties, while the sleeve can be made of material with good high temperature properties.

As per FIG. 1, when the cylinder 10 is assembled as described, the spaced-apart annular recesses 39*e* and 39*i* define liquid coolant reservoirs 50*e* and 50*i* on the sidewall 11 that are in the vicinity of the exhaust and intake ports 13 and 14, respectively. The first reservoir 50*e* is an annular space just inboard of the exhaust port 13 and the second liquid reservoir 50*i* is an annular space just inboard of the intake port 14. The open feed channels 38 are covered by the sidewall sections 11*e*, 11*s*, and 11*i* so as to define continuous feed channels having first ends in liquid communication with the coolant reservoir 50*e* and second ends in liquid communication with the coolant reservoir 50*i*. As best seen in FIG. 1, each of the impingement jet ports 33 is in liquid communication with a respective one of the feed channels 38. As per FIGS. 1 and 2, the bridges of the exhaust port 13 are drilled through to form channels 52 with first ends in liquid communication with the coolant reservoir 50*e* and second ends with openings 54 in the vicinity of an exhaust end of the cylinder 10. A plurality of liquid coolant bypass ports 56 formed by radial drillings in the sleeve 10S are in liquid communication with the first coolant reservoir 50*e*. The sleeve 10S further includes loop channels 58 formed by longitudinal drillings in the ribs 37 having first and second ends that are in liquid communication with the coolant reservoirs 50*e* and 50*i*, respectively.

Figure 4:
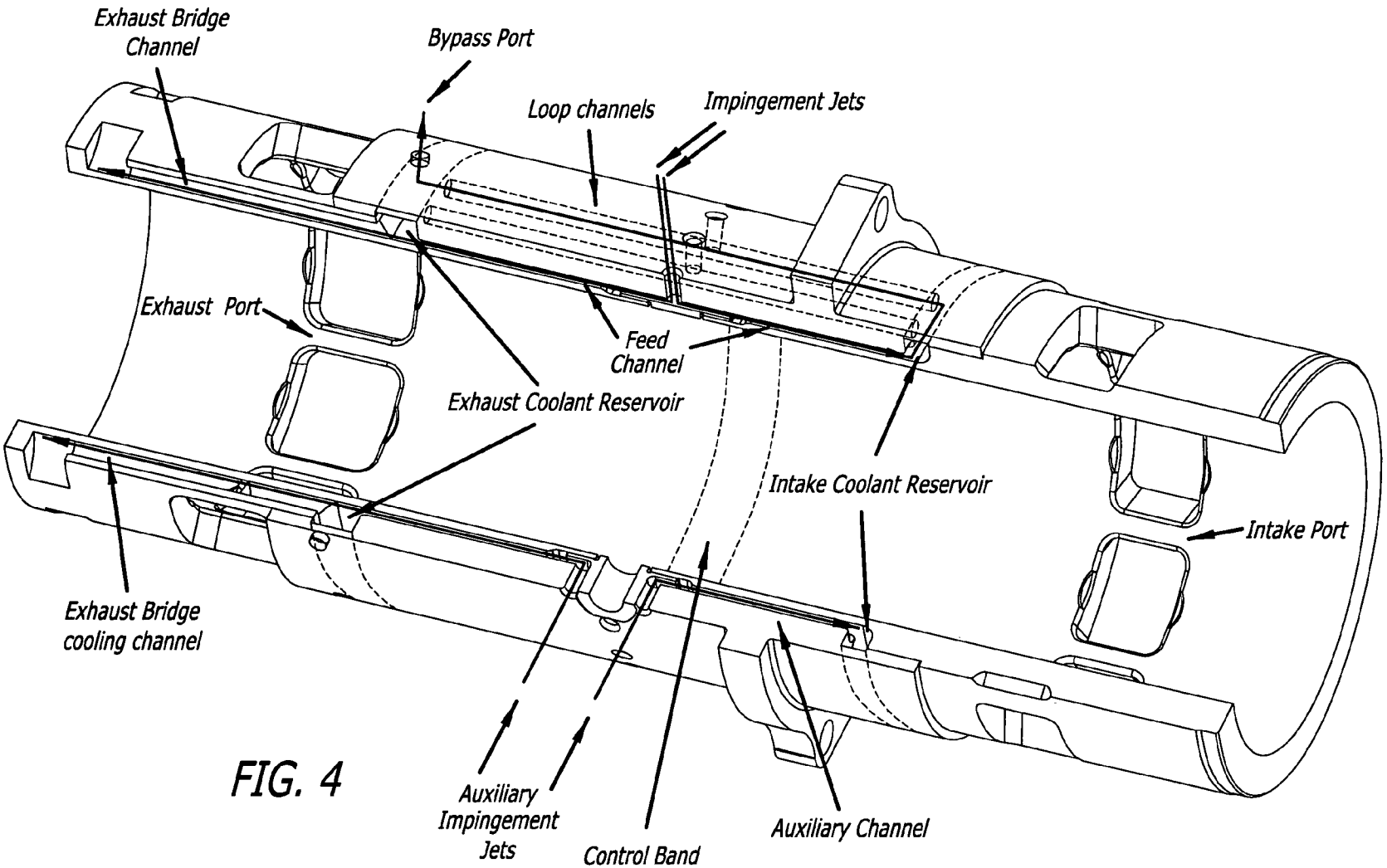
FIG. 4 is a diagram depicting liquid coolant flow on the cylinder of FIG. 1.

With reference to FIG. 4, the impingement cooling system is operated by provision of liquid coolant under pressure in each of the impingement jet ports 24. High-speed jets of liquid coolant formed in the ports 33 travel radially into the cylinder assembly 10 where they strike the sidewall 11. The liquid coolant thereby introduced into the cylinder assembly 10 flows in the feed channels 38, through the first and second ends thereof and into the coolant reservoirs 50*e* and 50*i*. Liquid coolant collected in the coolant reservoir 50*i* loops back to the coolant reservoir 50*e* though the loop channels 58. From the coolant reservoir 50*e*, liquid coolant can flow through the bridge channels 52 in the exhaust port 13, or out the bypass ports 56. The bypass ports are provided for the purpose of regulating the pressure in the coolant reservoir 50*e* in order to control the degree of cooling delivered to the exhaust end of the cylinder assembly. In this regard, if the liquid coolant flow through the exhaust bridges exceeds a level appropriate for current engine operating conditions, the exhaust end of the bore 12 can be excessively cooled, resulting in a smaller diametric cross-section than at the intake end of the bore. In order to prevent or mitigate such a condition, outflow through the bypass ports 56 can be set to a level that reduces the flow of liquid coolant through the exhaust port bridges. Outflow of liquid coolant through the bypass ports 56 can be set to a constant rate during manufacture and assembly by appropriately sizing the bypass ports; or it can be set and changed dynamically by a controlled valving arrangement in response to engine operating conditions.

In some aspects, it is desirable to provide additional cooling capacity in the vicinity of injector ports to dissipate local hot spots in the central band that occur due to structural discontinuities associated, for example, with injector ports. In this regard, with reference to FIGS. 1 and 2, auxiliary jet ports 60 are formed in the sleeve 10S, laterally of an injector port where the boss 36 is retained. Auxiliary feed channels 62 that extend from the central band to one or another of the coolant reservoirs 50*e* and 50*i* are formed on the inside surface 31 of the sleeve.

Figure 5:
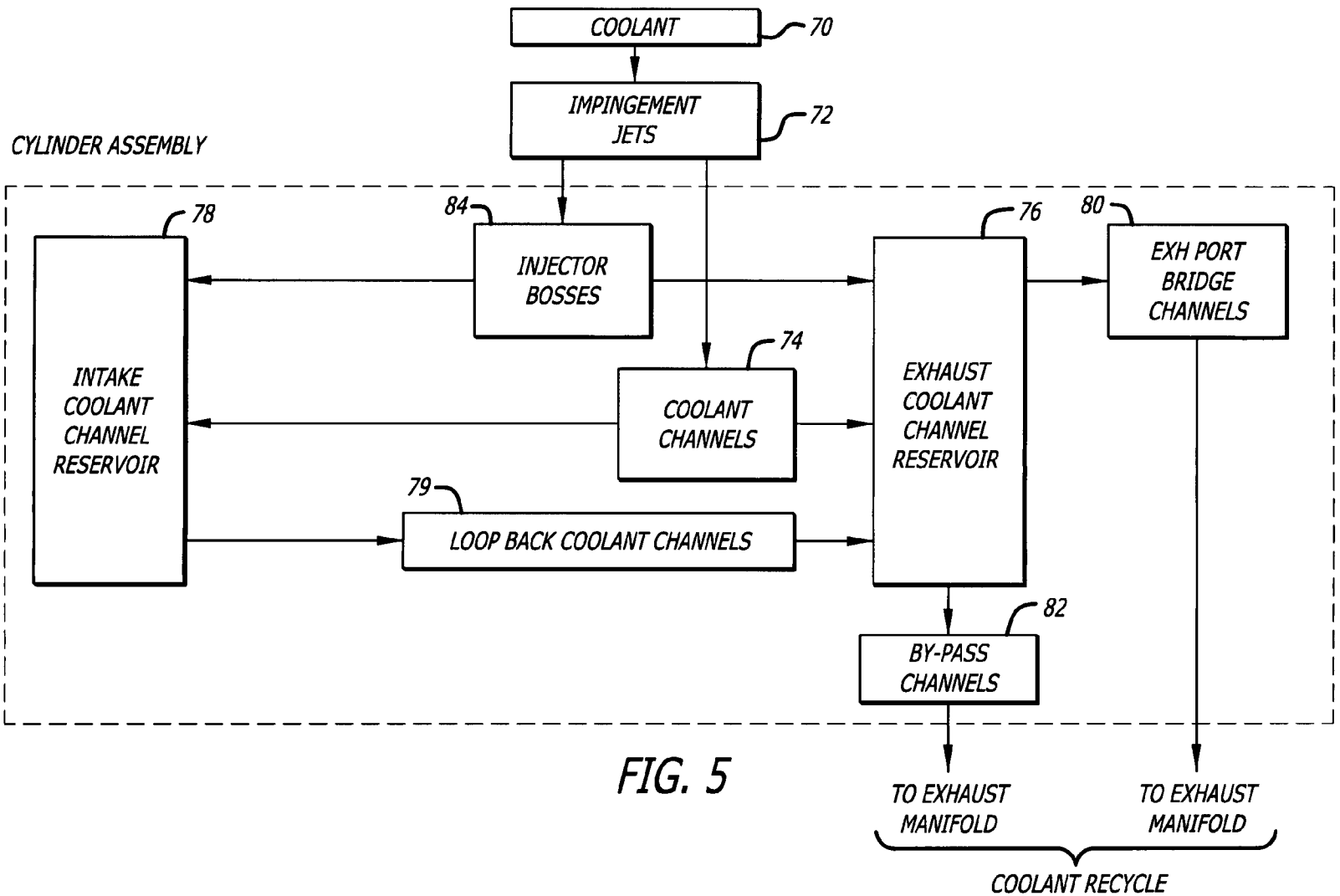
FIG. 5 is a diagram illustrating a method of cooling a cylinder of an opposed-piston engine, using the cylinder of FIG. 1 as an illustrative example.

As per FIGS. 2 and 5, an opposed-piston engine includes at least one ported cylinder in the bore of which a pair of pistons is disposed for opposed sliding movement. The engine includes one or more reservoirs of liquid coolant, a pump assembly, and a distribution network to transport pressurized liquid coolant to and from the ported cylinder during engine operation. Using the cylinder assembly 10 as an illustrative example, a method of cylinder cooling in the engine includes a step 70 wherein pressurized liquid coolant enters the impingement jet ports 24. At 72, jets of liquid coolant strike the sidewall of the cylinder. At 74, the coolant thereby applied to the sidewall is transported along the sidewall in the feed channels 38. At 76, liquid coolant in the feed channels is transported along the sidewall to the exhaust reservoir 50*e* in the vicinity of the exhaust port; at 78 liquid coolant in the feed channels is transported along the sidewall to the and to the intake reservoir 50*i* in the vicinity of the intake port. Liquid coolant is accumulated in the exhaust and intake reservoirs, providing annular concentrations of liquid coolant that relieves thermal stress at the locations where the bore's structural continuity is interrupted by the port bridges. At 79, liquid coolant accumulated in the intake reservoir is transported from the intake reservoir 50*i*, along the sidewall through the loop channels 58 to the exhaust reservoir 50*e*. At 80, liquid coolant accumulated in the exhaust reservoir is transported through the bridges of the exhaust port and out of the cylinder. At 82, liquid coolant accumulated in the exhaust reservoir is transported through the bypass ports 56 to adjust the fluid pressure acting on the liquid coolant transported to and through the exhaust port bridges. In some aspects of the cooling method, liquid coolant exiting the cylinder is transported to an exhaust manifold coolant channel (not seen) for cooling and recirculation. In other aspects of the cooling method, impingement jets of liquid coolant are introduced adjacent one or more injector ports through auxiliary liquid coolant jet ports at 84 and transported along the sidewall through auxiliary channels 62 to the exhaust and intake reservoirs 50*e* and 50*i*.

Second Embodiment: In a second embodiment illustrated in FIGS. 6-7, the cylinder structure includes a reinforcing annular member constituted as a central rib on the sidewall that is generally centered in the central band and that extends in a circumferential direction of the sidewall. Preferably, the central rib is continuous and unbroken. The central rib has first and second sides from which respective first and second groups of feed channels extend along the sidewall toward the exhaust and intake pots. Respective circumferential arrays of impingement jet ports are in liquid communication with the first and second groups of feed channels. An exhaust coolant reservoir in liquid communication with the first group of feed channels is disposed on the sidewall in the vicinity of the exhaust port, and an intake coolant reservoir in liquid communication with the second group of feed channels is disposed on the sidewall in the vicinity of the intake port. Bridge channels extending through bridges of the exhaust port have first ends that open to the exhaust coolant reservoir and have second ends that open through an exhaust end portion of the liner. Exit ports are provided for the exhaust and intake coolant reservoirs.

Figure 6:
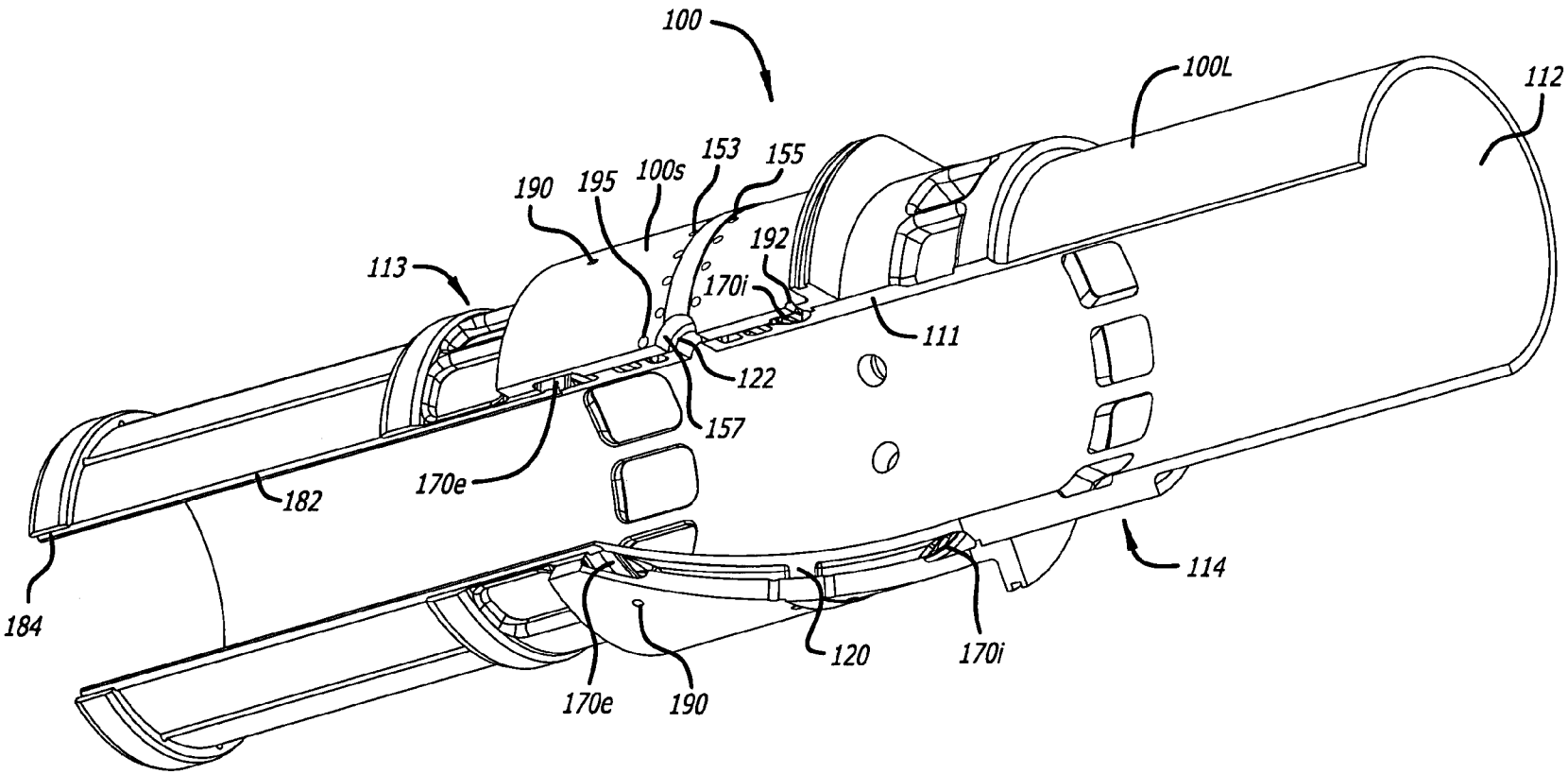
FIG. 6 is a partially cut away perspective view of a cylinder of an opposed-piton engine equipped with a second impingement cooling construction.
Figure 7:
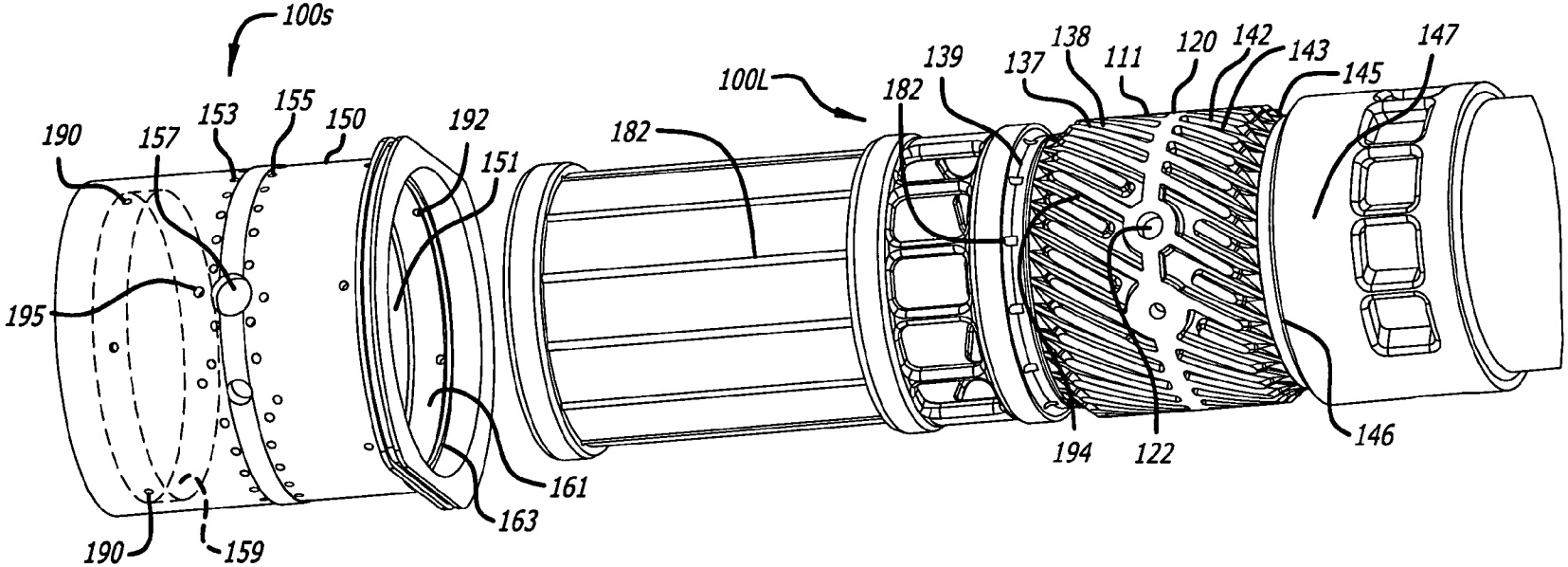
FIG. 7 is an exploded perspective view of the cylinder of FIG. 6.

Referring to FIGS. 6 and 7, the opposed-piston engine cylinder assembly 100 includes two cast and/or machined elements: a liner section 100L and a sleeve 10S. The liner section 100L is a cylindrical piece that is formed by casting and/or machining to include a sidewall 111, an exhaust section in which the openings of the exhaust port 113 are formed, an intake section in which the openings of the intake port 114 are formed, and a center section 115 therebetween. In the center section, the sidewall 111 is formed to include a reinforcing annular member constituted as a central rib 120. The central rib 120 is positioned generally at the center of the central band, and girds the liner section 100L in a circumferential direction of the section. The shape of the central rib 120 accommodates one or more ports 122 that open through the central band into the cylinder bore and are for mounting fuel injector nozzles; other such ports may be provided for mounting sensors, braking valves, and/or other mechanisms that require access to the bore. A first sequence of ribs 137 is formed from one side of the central rib 120. The spaces between the ribs 137 constitute a first group of open feed channels 138. The open feed channels 138 have first ends on the one side of the central rib 120 and second ends that open into a groove 139 on the liner section 100L in the vicinity of the exhaust port 113. A second sequence of ribs 142 is formed from one side of the central rib 120. The spaces between the ribs 142 constitute a second group of open feed channels 143. The open feed channels 143 have first ends on the other side of the central rib 120 and second ends that open into an annular groove 145 on the liner section 100L in the vicinity of the intake port 114. The outboard wall 146 of the annular groove 145 transitions to a liner portion having a surface portion 147.

Referring still to FIGS. 6-7, the cylinder sleeve 100S is a cylindrical piece that is formed by casting and/or machining to include outer and inner surfaces 150 and 151. A first plurality of impingement jet ports 153 is arranged in a first sequence extending in a circumferential direction of the sleeve 100S. A second plurality of impingement jet ports 155 is arranged in a second sequence extending in a circumferential direction of the sleeve 100S. The jet ports 153 and 155 are formed by drilling through the sleeve 100S from the outer to the inner surfaces 150, 151. Preferably, the centerlines of the jet ports are aligned with radii of the sleeve 10S. At least one injector port hole 157 located on the circumference centered between the circumferences of the first and second jet port sequences is formed by drilling in a radial direction of the sleeve 100S. Spaced-apart circumferential grooves 159 and 161 are formed near respective ends of the inside surface 151. The outboard side of the groove 161 transitions to an annular alignment flange 163.

With further reference to FIGS. 6-7, the cylinder 100 is assembled by passing the sleeve 100S over the exhaust end of the liner section 100L so as to bring the alignment flange 161 against the outboard wall 146 of the groove 145 on the liner section 100L. With the sleeve rotated so as to align the first sequence of jet ports 153 with first ends of the feed channels 138, the second sequence of jet ports with first ends of the feed channels 143, and the holes 157 with ports 122, the sleeve 100S and liner section 100L can be joined by one or more of press fitting, interference fitting, shrink fitting, welding, and soldering, or any equivalent thereof. This construction permits the application of liquid coolant to the cylinder assembly while sealing the bore and the one or more ports where fuel injector nozzles, sensors, braking valves, and/or other mechanisms that require access to the bore are to be mounted. Further, the central rib 120 that girds the central section of the cylinder receives the pressure of combustion when ignition occurs. It reinforces the central band of the cylinder, including the ports where fuel injector nozzles, sensors, braking valves, and/or other mechanisms are mounted.

The elements of the cylinder assembly can be made out of metallic material such as cast iron, steel, aluminum, bronze, and/or other equivalent materials. The multi-piece construction of the cylinder structure allows combinations that would align material characteristics with operational requirements. For example, the liner section 100L can be made of material with good tribological properties, while the sleeve 100S can be made of material with good high temperature properties As per FIGS. 6 and 7, when the cylinder 100 is assembled as described, the opposing annular grooves 139 and 159 define a first coolant reservoir 170*e* in the vicinity of the exhaust port 113, and the opposing annular grooves 143 and 161 define a second coolant reservoir 170*i* in the vicinity of the intake port 114. The first reservoir 170*e* is an annular space just inboard of the exhaust port 113 and the second liquid reservoir 170*i* is an annular space just inboard of the intake port 114. The open feed channels 138 and 143 are covered by the sleeve inside surface 151 so as to define continuous feed channels having first ends on respective sides of the central rib 120 and second ends in liquid communication with the coolant reservoirs 170*e* and 170*i* respectively. As best seen in FIG. 7, each of the impingement jet ports 153 is in liquid communication with a respective first end of one of the feed channels 138 and each of the impingement jet ports 155 is in liquid communication with a respective first end of one of the feed channels 143. As per FIGS. 6 and 7, the bridges of the exhaust port 113 are drilled through to form channels 182 with first ends in liquid communication with the coolant reservoir 170*e* and second ends with openings 184 in the vicinity of an exhaust end of the cylinder 100.

With reference to FIGS. 6 and 7, the impingement cooling system is operated by provision of liquid coolant under pressure in each of the impingement jet ports 153 and 155. Liquid jets formed in the ports 153 travel radially into the cylinder assembly 100 where they strike the sidewall 111. The liquid coolant thereby introduced into the cylinder assembly 100 flows in the feed channels 138, from the first to second ends thereof and into the coolant reservoir 170*e*. Liquid jets formed in the ports 155 travel radially into the cylinder assembly 100 where they strike the sidewall 111. The liquid coolant thereby introduced into the cylinder assembly 100 flows in the feed channels 143, from the first to second ends thereof, and into the coolant reservoir 170*i*. From the coolant reservoir 170*e*, liquid coolant can flow through the bridge channels 182 in the exhaust port 113, or out bypass ports 190. The bypass ports are provided for the purpose of regulating the pressure in the coolant reservoir 170*e* in order to control the degree of cooling delivered to the exhaust end of the cylinder assembly. In this regard, if the amount of liquid coolant flowing through the exhaust bridges exceeds a level appropriate for current engine operating conditions, the exhaust end of the bore 112 can be excessively cooled, resulting in a smaller diametric cross-section than at the intake end of the bore. In order to prevent or mitigate such a condition, outflow through the bypass ports 190 can be set to a level that reduces the flow of liquid coolant through the exhaust port bridges. Outflow of liquid coolant through the bypass ports 190 can be set to a constant rate during manufacture and assembly by appropriately sizing the bypass ports; or it can be set and changed dynamically by a controlled valving arrangement in response to engine operating conditions. Liquid coolant collected in the coolant reservoir 170*i* flows out through exit ports 192.

In some aspects, it is desirable to provide additional cooling capacity in the vicinity of injector ports to dissipate local hot spots in the central band that occur due to structural discontinuities associated, for example, with injector ports. In this regard, with reference to FIGS. 6-7, auxiliary jet ports 195 are formed in the sleeve 100S, laterally of an injector porthole 157. Auxiliary feed channels 194 that extend from the central rib 120 to one or another of the coolant reservoirs 170*e* and 170*i* are formed on the sidewall of the liner section 100L.

Using the cylinder assembly 100 as an illustrative example, a method of cylinder cooling in an opposed engine includes providing pressurized liquid coolant through the two sequences of impingement jet ports 153 and 155. Jets of liquid coolant emerging from these jet ports strike the sidewall of the cylinder liner; in this case, at the first ends of feed channels 138 and 143. The coolant thereby applied to the sidewall is transported along the sidewall in the feed channels 138 and 143. Liquid coolant in the feed channels 138 is transported along the sidewall to, and is accumulated in, the exhaust reservoir 170*e* in the vicinity of the exhaust port. Liquid coolant in the feed channels 143 is transported along the sidewall to, and is, accumulated in, the intake reservoir 170*i* in the vicinity of the intake port. Liquid coolant accumulated in the exhaust reservoir 170*e* is transported through the bridges of the exhaust port 113 out of the cylinder. Liquid coolant accumulated in the exhaust reservoir 170*e* is also transported through the bypass ports 190 to adjust the fluid pressure acting on the liquid coolant transported to and through the exhaust port bridges. Liquid coolant accumulated in the intake reservoir 170*i* exits the cylinder via the exit ports 192. In some aspects of the cooling method, liquid coolant exiting the cylinder is transported to an exhaust manifold coolant channel (not seen) for cooling and recirculation. In other aspects of the cooling method, impingement jets of liquid coolant are introduced adjacent one or more injector ports through auxiliary liquid coolant jet ports at 195 and transported along the sidewall through auxiliary channels 194 to the exhaust and intake reservoirs 170*e* and 170*i*.

Although the novel constructions and methods have been described with reference to a number of embodiments, it should be understood that various modifications can be made without departing from the spirit of the underlying principles.

The invention claimed is:

1. A cylinder construction for an opposed-piston engine, including a cylinder liner with a sidewall, longitudinally-spaced exhaust and intake ports opening through the sidewall, a bore, and a plurality of feed channels that extend along the sidewall from a central band of the cylinder toward the exhaust and intake ports, in which a sleeve covering the sidewall includes:

a plurality of impingement jet ports that are arranged in at least one sequence extending around the central band and that are in liquid communication with the plurality of feed channels; and, an inside surface with spaced-apart annular recesses defining liquid coolant reservoirs on the sidewall that are in liquid communication with the feed channels.

2. The cylinder construction for an opposed-piston engine of claim 1, further including an annular member disposed between the liner and the sleeve to reinforce the central band.

3. The cylinder construction for an opposed-piston engine of claim 2, in which the liquid coolant reservoirs include a first coolant reservoir in the vicinity of the exhaust port and a second coolant reservoir in the vicinity of the intake port, the exhaust port includes a plurality of bridges, and the cylinder further includes channels through the bridges with first ends in liquid communication with the first coolant reservoir and second ends with openings in the vicinity of an exhaust end of the cylinder.

4. The cylinder construction for an opposed piston engine of claim 3, in which the sleeve further includes a plurality of liquid coolant exit ports in liquid communication with the first coolant reservoir.

5. The cylinder construction for an opposed-piston engine of claim 4, in which the at least one sequence of impingement jet ports includes a sequence of impingement jet ports following a liner circumference that is aligned with an injector port.

6. The cylinder construction for an opposed piston engine of claim 5, in which the inside surface includes open feed channels that are covered by the sidewall.

7. The cylinder construction for an opposed piston engine of claim 6, in which the sleeve further includes loop channels that are in liquid communication with the first and second coolant reservoirs.

8. The cylinder construction for an opposed-piston engine of claim 5, in which the annular member is constituted of a ring of material disposed on the inside surface of the sleeve and following the liner circumference.

9. The cylinder construction for an opposed-piston engine of claim 4, in which the at least one sequence of impingement jet ports includes spaced-apart sequences of impingement jet ports following respective liner circumferences.

10. The cylinder construction for an opposed piston engine of claim 9, in which the sidewall includes an outside surface having the form of open feed channels that are covered by the sleeve.

11. The cylinder construction for an opposed piston engine of claim 10, in which the sleeve further includes liquid coolant exit ports in liquid communication with the second coolant reservoir.

12. The cylinder construction for an opposed piston engine of claim 11, in which the feed channels have curved shapes or straight shapes.

13. The cylinder construction for an opposed-piston engine of claim 9, in which the annular member is constituted of an unbroken circumferential rib on the sidewall and positioned between the respective liner circumferences.

14. A cylinder for an opposed-piston engine, including a liner with a sidewall, longitudinally-spaced exhaust and intake ports opening through the sidewall, a bore, and a plurality of feed channels that extend along the sidewall from a central band of the cylinder toward the .exhaust and intake ports, in which:

impingement jet ports arranged in a circumferential sequence around the central band are in liquid communication with the plurality of feed channels;

an exhaust coolant reservoir in liquid communication with the feed channels is disposed adjacent the sidewall in the vicinity of the exhaust port;

an intake coolant reservoir in liquid communication with the feed channels is disposed adjacent the sidewall in the vicinity of the intake port;

loop channels extending along the sidewall have first ends that open to the intake coolant reservoir and second ends that open to the exhaust coolant reservoir;

bridge channels extending through bridges of the exhaust port have first ends that open to the exhaust coolant reservoir and second ends that open through end exhaust end portion of the cylinder; and, a ring of material in the sidewall reinforces the central band.

15. The cylinder for an opposed-piston engine of claim 14, in which bypass ports open between the exhaust reservoir and the sidewall.

16. The cylinder for an opposed-piston engine of claim 14, in which:

the exhaust reservoir is disposed inboard of the exhaust port and extends around the sidewall in a circumferential direction of the cylinder; and, the intake reservoir is disposed inboard of the intake port and extends around the sidewall in a circumferential direction of the cylinder.

17. The cylinder for an opposed-piston engine of claim 16, in which bypass ports open between the exhaust reservoir and the sidewall.

18. The cylinder for an opposed-piston engine of claim 14, in which auxiliary jet ports adjacent an injector port in the central band are in liquid communication with respective auxiliary channels, each auxiliary channel having an end that opens into one of the exhaust and intake coolant reservoirs.

19. A cylinder for an opposed-piston engine, including a liner with a sidewall, longitudinally-spaced exhaust and intake ports opening through the sidewall, and a bore, in which:

a circumferential rib in the sidewall reinforces a central band of the liner;

a first group of feed channels extends along the sidewall from a first side of the circumferential rib toward the exhaust port;

a second group of feed channels extends along the sidewall from a second side of the circumferential rib toward the intake port;

a plurality of impingement jet ports arranged in a first circumferential sequence along the first side are in liquid communication with the first group of feed channels;

a plurality of impingement jet ports arranged in a second circumferential sequence along the second side are in liquid communication with the second group of feed channels;

an exhaust coolant reservoir in liquid communication with the first group of feed channels is disposed adjacent the sidewall in the vicinity of the exhaust port;

an intake coolant reservoir in liquid communication with the second group of feed channels is disposed adjacent the sidewall in the vicinity of the intake port; and, bridge channels extending through bridges of the exhaust port have first ends that open to the exhaust coolant reservoir and second ends that open through an exhaust end portion of the cylinder.

20. The cylinder for an opposed-piston engine of claim 19, in which bypass ports open between the exhaust reservoir and the sidewall.

21. The cylinder for an opposed-piston engine of claim 19, in which:

the exhaust reservoir is disposed inboard of the exhaust port and extends around the sidewall in a circumferential direction of the cylinder; and, the intake reservoir is disposed inboard of the intake port and extends around the sidewall in a circumferential direction of the cylinder.

22. The cylinder for an opposed-piston engine of claim 21, in which bypass ports open between the exhaust reservoir and the sidewall.

23. The cylinder for an opposed-piston engine of claim 19, in which auxiliary jet ports adjacent an injector port in the central band are in liquid communication with respective auxiliary channels, each auxiliary channel having an end that opens into one of the exhaust and intake coolant reservoirs.

* * * * *